US007324124B2

(12) United States Patent
Isaac et al.

(10) Patent No.: US 7,324,124 B2
(45) Date of Patent: Jan. 29, 2008

(54) PRINTER AND METHOD FOR DETECTING DONOR MATERIAL

(75) Inventors: Walter H. Isaac, Penfield, NY (US); Robert F. Mindler, Churchville, NY (US); Christine J. Landry-Coltrain, Fairport, NY (US); Sharon P. Markel, Honeoye Falls, NY (US)

(73) Assignee: Eastman Kodak Company, Rochester, NY (US)

( * ) Notice: Subject to any disclaimer, the term of this patent is extended or adjusted under 35 U.S.C. 154(b) by 236 days.

(21) Appl. No.: 11/282,823

(22) Filed: Nov. 18, 2005

(65) Prior Publication Data

US 2007/0115341 A1 May 24, 2007

(51) Int. Cl.
*B41J 35/00* (2006.01)

(52) U.S. Cl. ..... 347/177; 400/247

(58) Field of Classification Search ..... 347/177–178, 347/217; 400/247

See application file for complete search history.

(56) References Cited

U.S. PATENT DOCUMENTS 4,933,315 A 6/1990 Kanto et al.
5,982,405 A 11/1999 Sasaki et al.
6,071,024 A * 6/2000 Chi-Ming et al. ..... 400/120.02
6,080,993 A 6/2000 Zwijsen
2006/0181596 A1* 8/2006 Mindler et al. ..... 347/171
2006/0181597 A1* 8/2006 Mindler ..... 347/171
2007/0024693 A1* 2/2007 Anderson et al. ..... 347/213

FOREIGN PATENT DOCUMENTS

JP 60-198267 10/1985
JP 63-176168 7/1988
JP 04-074692 7/1990

* cited by examiner

*Primary Examiner*—Huan Tran

(57) ABSTRACT

Thermal printers and methods for operating a thermal printer that applies donor material from donor patches on a donor ribbon to a received medium, the donor material being organized into sets, each set including at least one colored donor material patch and a protective material donor patch. A non-visible light is applied to a location on the donor ribbon, and a portion of the non-visible light that is not absorbed by the donor ribbon is sensed. The sensed non-visible light determines whether the portion of the donor ribbon to which the non-visible light has been applied has unused protective donor material thereon.

21 Claims, 10 Drawing Sheets

PRINTER AND METHOD FOR DETECTING DONOR MATERIAL

CROSS-REFERENCE TO RELATED APPLICATIONS

Reference is made to commonly assigned, co-pending patent applications U.S. Ser. No. 11/060,178, entitled SYSTEM AND METHOD FOR EFFICIENT DONOR MATERIAL USE, filed Feb. 17, 2005 in the name of Robert F. Mindler; U.S. Ser. No. 11/238,386, entitled SYSTEM AND METHOD FOR EFFICIENT DONOR MATERIAL USE, filed Sep. 29, 2005 in the names of Robert F. Mindler et al.; and U.S. Ser. No. 11/060,177, entitled SYSTEM AND METHOD FOR EFFICIENT DONOR MATERIAL USE, filed Feb. 17, 2005 in the names of Robert F. Mindler et al.

FIELD OF THE INVENTION

The present invention relates to thermal printers of type that apply material from a donor ribbon to a receiver medium in order to form images on the receiver medium.

BACKGROUND OF THE INVENTION

In thermal printing, it is generally well known to render images by heating and pressing one or more donor materials such as a dye, colorant or other coating against a receiver medium. The donor materials are provided in sized donor patches on a movable web known as a donor ribbon. The donor patches are organized on the ribbon into donor sets, each set containing all of the donor patches that are to be used to record an image on the receiver medium. For full color images, multiple color dye patches can be used, such as yellow, magenta and cyan donor dye patches. Arrangements of other color patches can be used in like fashion within a donor set. Additionally, each donor set can include an overcoat or sealant layer It will be appreciated from this that in conventional thermal printers the size of the donor media patches defines the maximum size of full size image that can be printed using thermal printer. To provide flexibility of use, many thermal printers are capable of printing relatively large images such as 6"×8" images. While prints of this size are highly desirable for many uses, it can be challenging to use and store images printed at this size. Accordingly, consumers often request that such printers render images at a fraction of the full size image, such as images printed at the wallet size, 3"×5" size or 4"×6" size. Images at these sizes are more easily used and stored and require only a fraction of the donor material from a donor patch set.

Unfortunately, most printers of the prior art are not adapted to efficiently use the donor material from the fractional donor patch set for printing other images. Instead, it is conventionally known to have a thermal printer advance to the next complete donor set after printing a fractional size image so that the thermal printer is prepared to print any size image when the next printing order is received. It will be appreciated that this results in inefficient use of the donor material by causing increased printing costs. What is needed therefore is a method and system that enable more efficient use of donor material in a printing system.

It will also be appreciated that many printing systems are adapted so that they can receive a variety of different donor ribbons and that it is not unusual for a donor ribbon to be removed from a printer when only some of the available donor sets on the donor ribbon have been used or partially used for fractional size printing. However, a problem can occur when such a partially used donor ribbon is reinstalled into a printer. Specifically, it will be appreciated that the printer often has no knowledge of whether the donor ribbon is positioned in the printer such that the printhead is confronting a full donor patch set or a fractional donor patch set. Further, the printer has no knowledge of the number of full donor patches remaining on a donor ribbon or the number of fractional donor patches remaining on a donor ribbon.

Such information can be tracked and manually provided to the printer, however, such a manual process introduces the prospect of human error and adds labor costs. Accordingly, a wide variety of prior art systems attempt to use encodements, markings, memory devices and more recently radio frequency identification tags to store data from which a printer can determine the location of unused donor material set on a donor ribbon. This however, requires that the printer is adapted with special readers and/or writing equipment to read and/or write the marking.

What is needed therefore is a printer that is adapted to directly detect whether a donor patch on a donor ribbon has been loaded with one or more donor set with a full donor patch area available, a fractional donor patch area available or an unused donor patch area available.

SUMMARY OF THE INVENTION

In one aspect of the invention, a thermal printer is provided. The thermal printer is adapted to print using a donor ribbon having sets of donor material patches each set including at least one colored donor material patch and a protective material donor patch, the donor ribbon absorbing a greater portion of an applied non-visible light in an area of the donor ribbon having unused protective donor material than in areas that do not have unused protective donor material; the thermal printer comprising: a donor transport system having a motorized system for advancing the donor ribbon relative to a printhead; a light source radiating non-visible light onto the donor ribbon; and, a light sensor positioned to sense a non-absorbed portion of the non-visible light radiated onto the donor ribbon and to generate a light sensor signal indicative of the non-visible light received; a controller being adapted to position the donor ribbon relative to the light source and the light sensor, to cause the light source to radiate non-visible light onto the donor ribbon and to receive the light sensor signal; the controller further being adapted to use the light sensor signal to identify whether the portion of the donor web confronting the light source and light sensor has unused protective donor material.

In another aspect of the invention, a method for operating a printer that applies donor material from donor patches on a donor ribbon to a receiver medium, the donor patches being organized into sets each set including at least one colored donor material patch and a protective material donor patch, the method comprising the steps of: applying a non-visible light to a location on the donor ribbon; sensing a portion of non-visible light that is not absorbed by the donor ribbon; and determining whether the portion of the donor patch to which the non-visible light has been applied has unused protective donor material thereon, said determining being based upon the sensed non-visible light.

In still another aspect of the invention, a method for operating a printing system is provided. The method applies donor material from a donor ribbon having donor patch sets, each donor patch set comprising at least one colored donor material patch and a protective material donor patch, the protective material donor patch having a material therein that absorbs non-visible light; the method comprising the steps of: applying a non-visible light to a first location within the protective material donor patch; sensing non-visible light that is not absorbed by the protective material donor patch at the first location; determining whether there is unused protective donor material at the first location based upon the non-visible light sensed at the first location; applying non-visible light to a second location within the protective material donor patch; sensing non-visible light that is not absorbed by the protective material donor patch at the second location; determining whether there is unused donor material at the second location based upon the non-visible light sensed at the second location; determining that the donor patch set has not been used when unused protective donor material is present at the first location; determining that the donor patch set is fully exhausted when it is determined that there is no unused protective donor material at the second location; and determining that the donor patch set has been used but has sufficient donor material available for fractional size printing when no unused protective donor material is found at the first location but unused protective donor material is found at the second location.

DETAILED DESCRIPTION OF THE INVENTION

Figure 1:
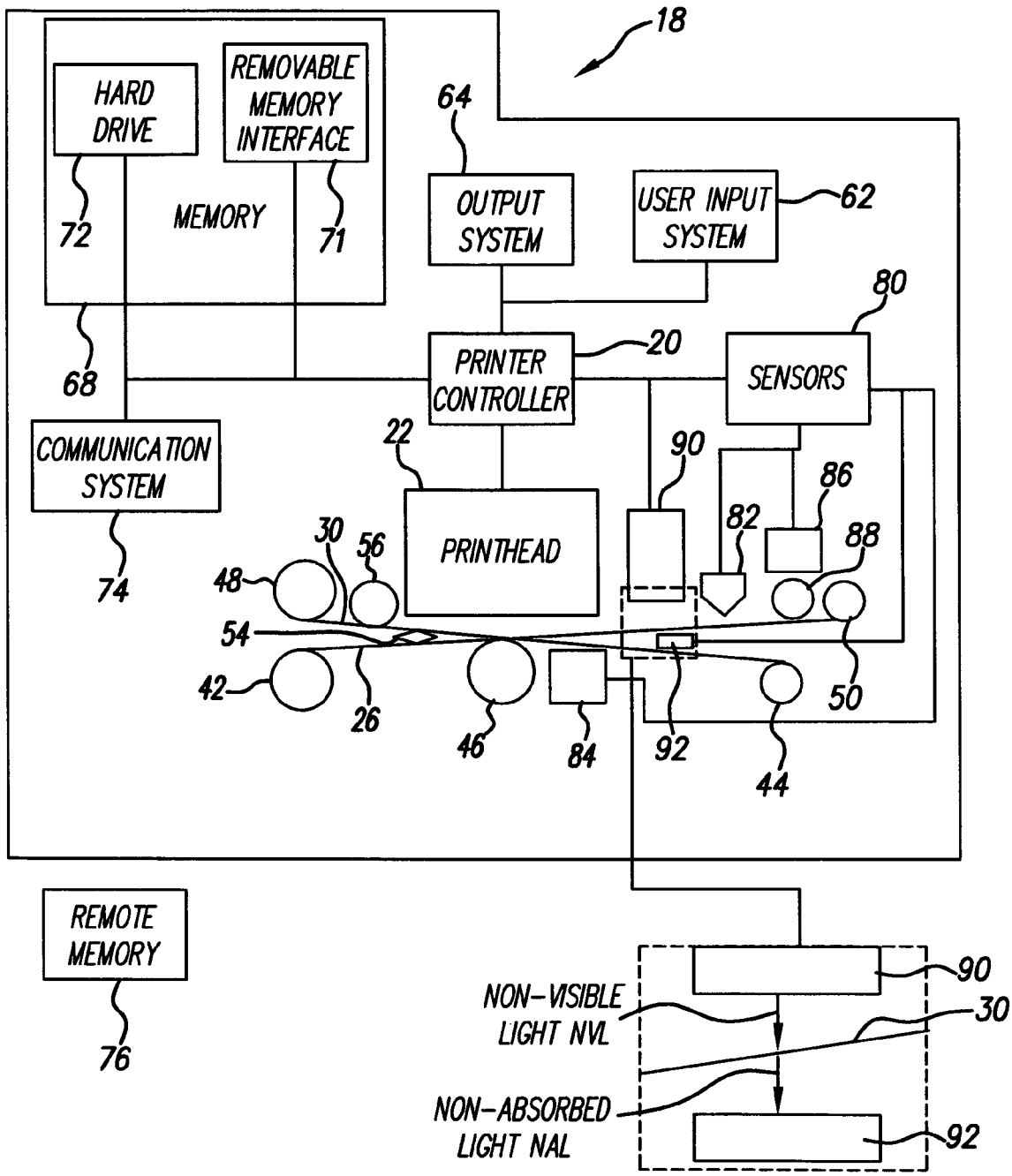
FIG. 1 illustrates a first embodiment of a printer.

FIG. 1 shows a first embodiment of a printer 18. As is shown in FIG. 1, in this embodiment printer 18 has a controller 20. Controller 20 causes printhead 22 to record images on a receiver medium 26 by transferring material from a donor ribbon 30 to receiver medium 26. Controller 20 can include, but is not limited to, a programmable digital computer, a programmable microprocessor, a programmable logic controller, a series of electronic circuits or a series of electronic circuits reduced to the form of an integrated circuit, or a series of discrete components. In the embodiment of FIG. 1, controller 20 also controls a receiver medium take-up roller 42, a receiver medium supply roller 44, a donor ribbon take-up roller 48 and a donor ribbon supply roller 50, which are each motorized for rotation on command of the controller 20 to effect movement of receiver medium 26 and donor ribbon 30.

Figure 2:
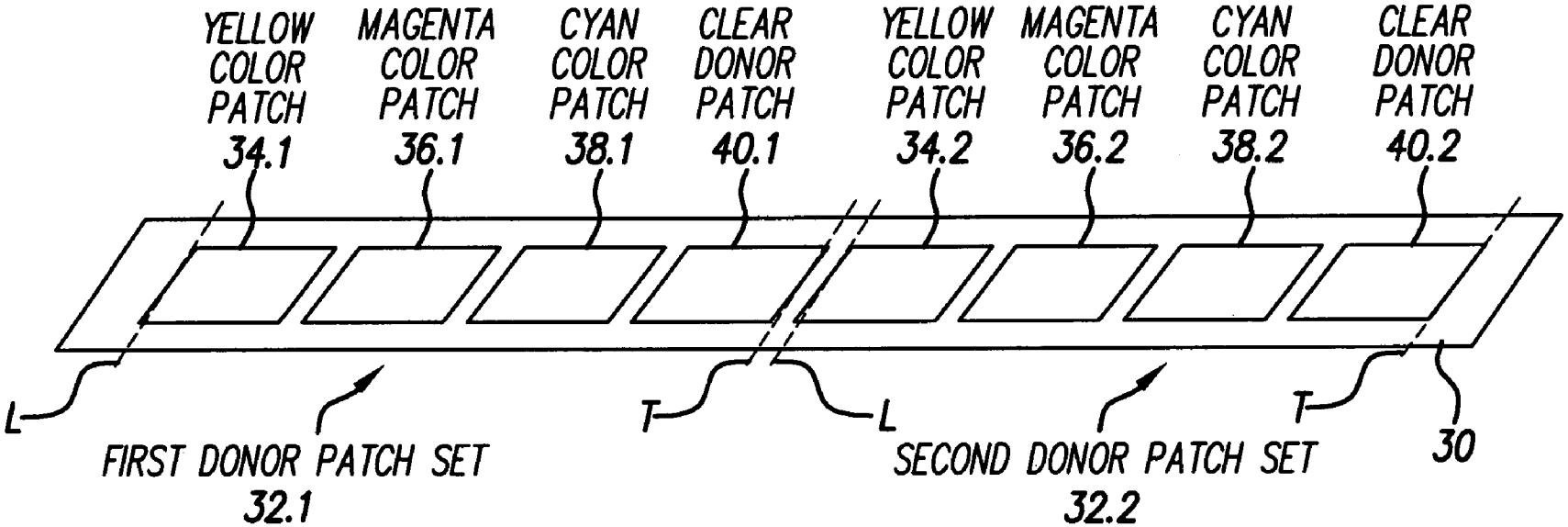
FIG. 2 illustrates a donor ribbon.
Figure 3:
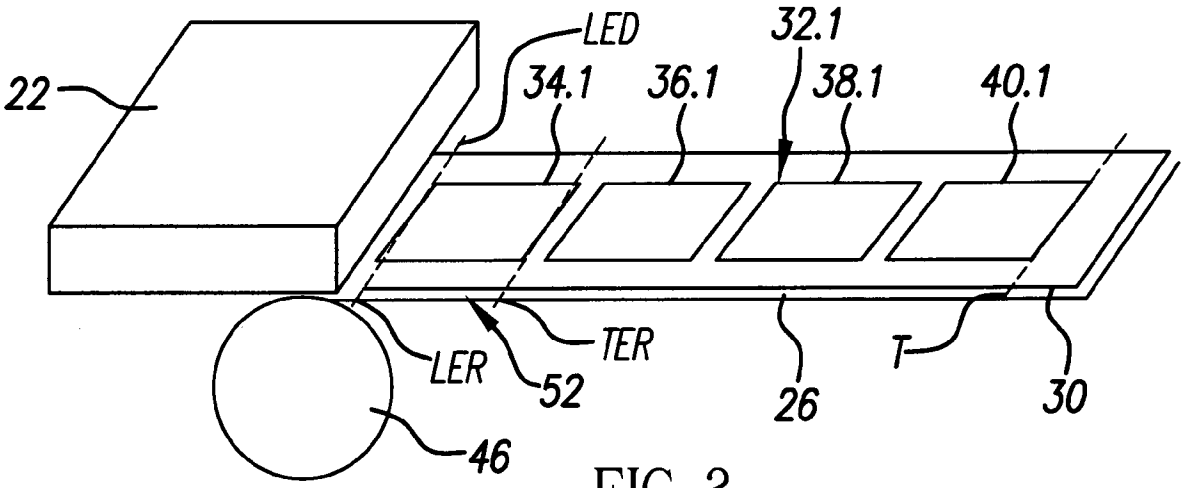
FIGS. 3 and 4 illustrate various steps in printing using the ribbon of FIG. 2.

As is shown in FIG. 2, donor ribbon 30 comprises a first donor patch set 32.1 and a second donor patch set 32.2. Each donor patch set 32.1 and 32.2 has at least one colored donor patch and a protective donor patch. For example, donor ribbon 30 of FIG. 2 is shown having a yellow donor patch 34.1, a magenta donor patch 36.1, a cyan donor patch 38.1 and a protective material donor patch 40.1 illustrated in FIGS. 2-4 and 7-9 as a clear overcoat patch and a second donor patch set 32.2 having a yellow donor patch 34.2, a magenta donor patch 36.2, a cyan donor patch 38.2 and protective material donor patch 40.2 illustrated in FIGS. 2-4 and 7-9 as a clear overcoat patch. Each donor patch set 32 has a leading edge (L) and a trailing edge (T). In order to provide a full color image with a clear protective coating, the four patches of each set 32.1 and 32.2 are printed, in registration with each other, within a common image receiving area 52 of receiver medium 26 as shown in FIG. 3. It will be appreciated that other arrangements of color donor patches can be used, such as other combinations of color donor materials. Further, the protective donor material used in protective donor patches can take many forms and can include, for example and without limitation, a substantially transparent protective material, a colored or tinted protective material, a watermarked material, a steganographically encoded material, or any other non-opaque material that can be applied over an image formed on receiver medium 26 or a portion of such an image, and through which the formed image can be seen. Protective material donor patches 40.1 and 40.2 can be used to protect an image formed on receiver medium 26 from frictional or other mechanical forces, electrical energy, environmental exposure, such as to light, heat, humidity, chemical exposure, or exposure to or contact with any potentially damaging material or substance.

A first color is printed in the conventional direction, from right to left as seen by the viewer in FIGS. 1 and 3. During printing, controller 20 raises printhead 22 and actuates donor ribbon supply roller 50 and donor ribbon take-up roller 48 to advance a leading edge L of a first donor patch set 32.1 to printhead 22. In the embodiment illustrated in FIGS. 1-3, leading edge L for first donor patch set 32.1 is defined by a leading edge of a yellow donor patch 34.1. The position of this leading edge L can be determined in a variety of ways, for example, by using a position sensor to detect a marking, indicia on donor ribbon 30 that has a known position relative to the leading edge of yellow donor patch 34.1.

Controller 20 also actuates receiver medium take-up roller 42 and receiver medium supply roller 44 so that image-receiving area 52 of receiver medium 26 is positioned with respect to the printhead 22. In the embodiment illustrated, image-receiving area 52 is defined by a leading edge LER and a trailing edge TER on receiver medium 26. When donor ribbon 30 and receiver medium 26 are positioned so that leading edge LED of yellow donor patch 34.1 is registered at printhead 22 with leading edge LER of image receiving area 52. Controller 20 then causes a motor or other conventional structure to (not shown) to lower printhead 22 so that a lower surface of donor ribbon 30 engages receiver medium 26 which is supported by the platen roller 46.

Figure 4:
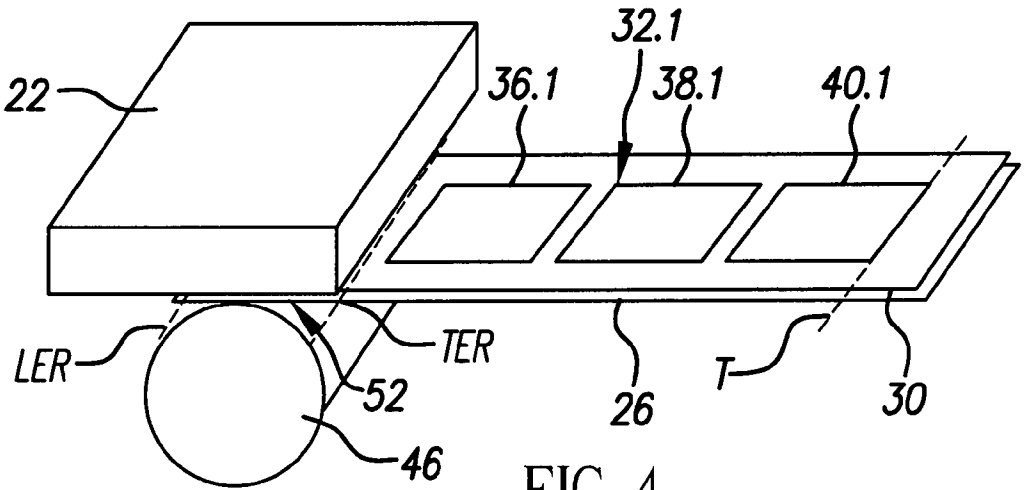

Controller 20 then actuates receiver medium take-up roller 42, receiver medium supply roller 44, donor ribbon take-up roller 48 and donor ribbon supply roller 50 to move receiver medium 26 and donor ribbon 30 together past the printhead 22. Concurrently, controller 20 selectively operates heater elements (not shown) in printhead 22 to transfer donor material from yellow donor patch 34.1 to receiver medium 26. As donor ribbon 30 and receiver medium 26 leave the printhead 22, a stripping plate 54 separates donor ribbon 30 from receiver medium 26. Donor ribbon 30 continues over idler roller 56 toward the donor ribbon take-up roller 48. As shown in FIG. 4, the trailing edge TER of image receiving area 52 of receiver medium 26 remains on platen roller 46. Controller 20 then adjusts the position of donor ribbon 30 and receiver medium 26 using a predefined pattern of donor ribbon movement so that a leading edge of each of the remaining donor patches 36.1, 38.1 and 40.1 in the first donor patch set 32.1 are brought into alignment with leading edge LER of image receiving area 52 and the printing process is repeated to transfer further material as desired to complete image format.

Controller 20 operates the printer 18 based upon input signals from a user input system 62, an output system 64, a memory 68, a communication system 74 and sensors 80. User input system 62 can comprise any form of transducer or other device capable of receiving an input from a user and converting this input into a form that can be used by controller 20. For example, user input system 62 can comprise a touch screen input, a touch pad input, a 4-way switch, a 6-way switch, an 8-way switch, a stylus system, a trackball system, a joystick system, a voice recognition system, a gesture recognition system or other such systems. An output system 64, such as a display, is optionally provided and can be used by controller 20 to provide human perceptible signals for feedback, informational or other purposes.

Data including but not limited to control programs, digital images and metadata can also be stored in memory 68. Memory 68 can take many forms and can include without limitation conventional memory devices including solid state, magnetic, optical or other data storage devices. In the embodiment of FIG. 1, memory 68 is shown having a removable memory interface 71 for communicating with removable memory (not shown) such as a magnetic, optical or magnetic disks. In the embodiment of FIG. 1, memory 68 is also shown having a hard drive 72 that is fixed with printer 18 and a remote memory 76 that is external to printer 18 such as a personal computer, computer network or other imaging system.

In the embodiment shown in FIGS. 1-3, controller 20 has a communication system 74 for communicating with external devices such as remote memory 76. Communication system 74 can be for example, an optical, radio frequency circuit or other transducer that converts electronic signals representing an image and other data into a form that can be conveyed to a separate device by way of an optical signal, radio frequency signal or other form of signal. Communication system 74 can also be used to receive a digital image and other information from a host computer or network (not shown). Controller 20 can also receive information and instructions from signals received by communication system 74.

Sensor system 80 includes circuits and systems that are adapted detect conditions within printer 18 and, optionally, in the environment surrounding printer 18 and to convert this information into a form that can be used by controller 20 in governing printing operations. These can take a wide variety of forms depending on the type of media therein and the operating environment in which printer 18 is to be used.

In the embodiment of FIG. 1, sensor system 80 includes an optional donor position sensor 82 that is adapted to detect the position of donor ribbon 30 and a receiver medium position sensor 84. Controller 20 cooperates with donor position sensor 82 to monitor donor ribbon 30 during movement thereof so that controller 20 can detect one or more conditions on donor ribbon 30 that indicate a leading edge of a donor patch set. In this regard, a donor ribbon 30 can be provided that has markings or other optically, magnetically or electronically sensible indicia between each donor patch set 32 and/or between donor patches 34, 36, 38 and 40. Where such markings or indicia are provided, position sensor 82 is provided to sense these markings or indicia and to provide signals to controller 20. Controller 20 can use these markings and indicia to determine when donor ribbon 30 is positioned with the leading edge of the donor patch set at printhead 22. In a similar way, controller 20 can use signals from receiver medium position sensor 84 to monitor the position of the receiver to align receiver medium 26 during printing. Receiver medium position sensor 84 can likewise be adapted to sense markings or other optically, magnetically or electronically sensible indicia between each image receiving area of receiver medium 26.

During a full image printing operation, controller 20 causes donor ribbon 30 to be advanced in a predetermined pattern of distances so as to cause a leading edge of each of the first donor patches 34.1, 36.1, 38.1 and 40.1 to be properly positioned relative to the leading edge L of image receiving area 52 at the start each printing process. Controller 20 can optionally be adapted to achieve such positioning by using, for example, the precise control of the movement of donor ribbon 30 when using a stepper type motor drives donor ribbon take-up roller 48 or donor ribbon supply roller 50 or by using a movement sensor 86 that can detect movement of donor ribbon 30. This option is used in FIG. 1 wherein an arrangement using a movement sensor 86, and a follower wheel 88 are provided that engages donor ribbon 30 and moves therewith. Follower wheel 88 can have surface features that are optically, magnetically or electronically sensed by movement sensor 86. One example of this is a follower wheel 88 that has markings thereon indicative of an extent of movement of donor ribbon 30 and a movement sensor 86 that has a light sensor that can sense light reflected by the markings. In other optional embodiments, perforations, cutouts or other routine and detectable indicia can be incorporated onto donor ribbon 30 in a manner that enables movement sensor 86 to provide an indication of the extent of movement of the donor ribbon 30.

Alternatively, donor position sensor 82 can also optionally be adapted to sense the color of donor patches on donor ribbon 30 and can provide color signals to controller 20. In this alternative, controller 20 is programmed or otherwise adapted to detect a color that is known to be found in the first donor patch, e.g. yellow donor patch 34.1 in a donor patch set such as first donor patch set 32.1. When the first color is detected, controller 20 can determine that donor ribbon 30 is positioned proximate to the start of a donor patch set.

A further alternative for determining a position for locating a leading edge of donor ribbon 30 will be described in greater detail and claimed herein.

Controller 20 is operable to cause printing of at least two differently sized images. In a full image mode, controller 20 causes printhead 22 to print images having image sizes will exhaust most or all of the donor material in the donor patches of a donor patch set. In one example of full image mode printing, some individual images will be sized so that they will require donor material from an entire donor patch. The full image-printing mode can also involve printing combinations of images that will likewise consume substantially all of the donor material available in a single donor patch set. One example of this is a request for a set of multiple wallet-sized prints. Controller 20 is also adapted to print fractional size images having various sizes that exhaust only a fraction of the donor material provided by a donor patch set and that leave a fractional donor patch set having donor patches with unused donor material that can be used to form an additional fractional size image.

Conventionally, donor material from a donor patch set that is unused during the printing of a fractional size image is wasted as the conventional printer simply advances the donor ribbon 30 from first donor patch set 32.1 to second donor patch set 32.2 before initiating a next job. However, as described and claimed in commonly assigned U.S. patent application Ser. No. 11/060,178 incorporated by reference, controller 20 and sensors 80 can be adapted to operate in a novel mode that allows controller 20 to execute a first print order using a portion of donor material from a first donor patch set 32.1 and to further use remaining portions of the donor material from the first donor patch set 32.1 to render at least a portion of a second print order.

Figure 5:
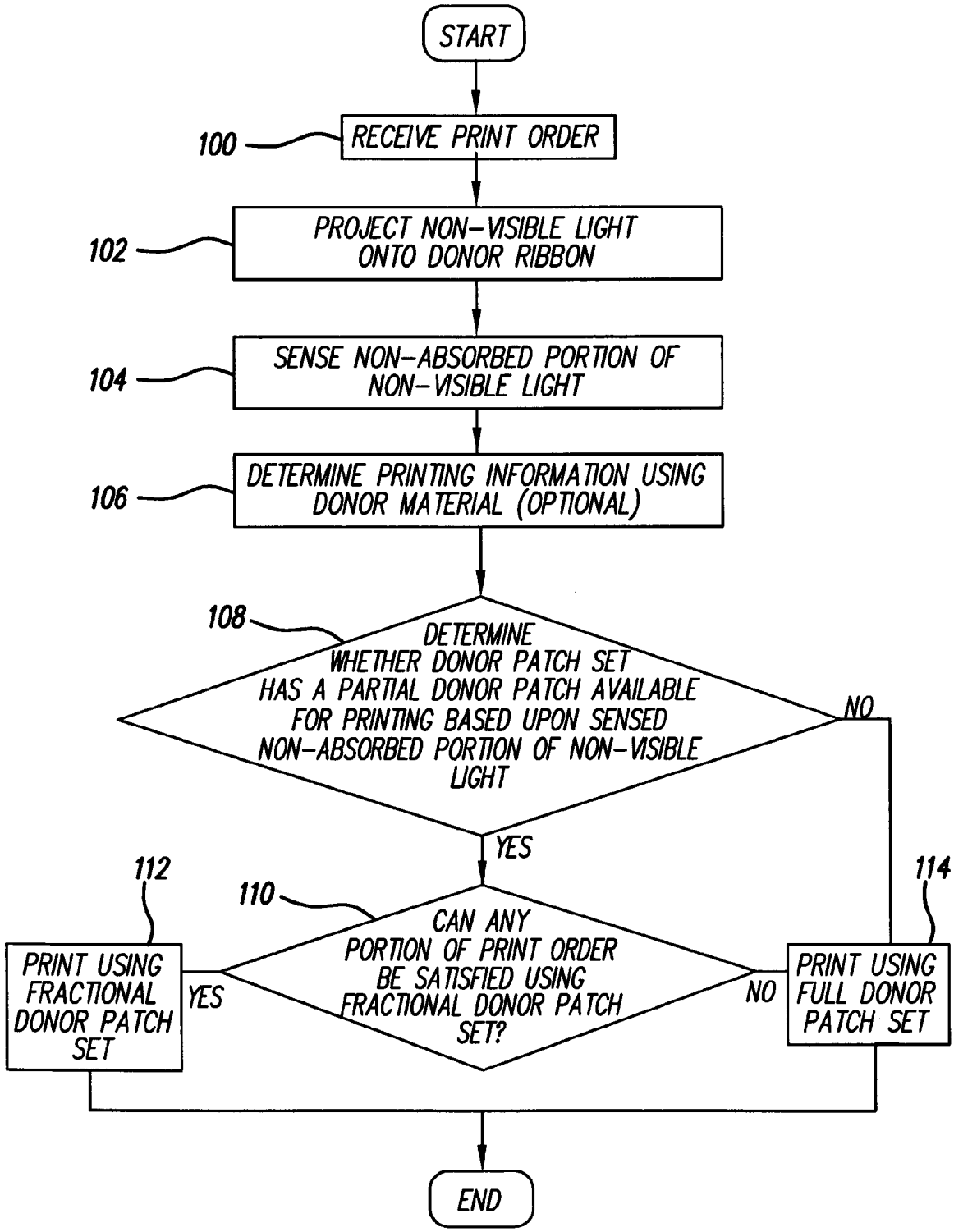
FIG. 5 is a flow diagram showing one embodiment of a method for operating a printer.

FIG. 5 provides a flow diagram showing one embodiment of a method for operating a printer 18 that is adapted to print full size and fractional size images. As is shown in the embodiment of FIG. 5 an initial print order is received by the printer (step 100). Controller 20 can receive the print order in a variety of ways including but not limited to receiving entries made by way of user input system 62, signals received at a communication system 74 or in response to a data provided by way of memory 68 including but not limited to data provided by way of a removable memory (not shown).

The print order contains instructions sufficient for controller 20 to initiate printing operations. Thus, each print order generally provides sufficient information from which controller 20 can determine what image is to be printed and the quantity of images to be printed. Typically, the print order will provide image data for the image to be printed, however, the print order can simply designate a location at which the printer can obtain the image data. As is shown in the embodiment of FIG. 5, controller 20 determines whether a fractional donor set is available on donor ribbon 30.

In accordance with the present invention this determination is made using a novel arrangement sensors within sensor system 80. Specifically as is shown in FIG. 1, sensor system 80 comprises a non-visible light source 90 that projects or otherwise provides a non-visible light NVL onto donor ribbon 30 (step 102). Non-visible light source 90 can radiate light in the ultraviolet or infrared wavelengths or in any other non-visible wavelength. Examples of such non-visible light include, but are not limited to, near infrared light of the type found at wavelengths of about 800-2500 nm (12,500-4000 $cm^{-1}$), mid-infrared light of the type found at wavelengths of about 2500-25,000 nm (4000-400 $cm^{-1}$), or ultraviolet light found in ranges of wavelengths of about 200-400 nm (50,000-25,000 $cm^{-1}$). It will be appreciated that in general however, the non-visible light can comprise any light at any wavelength outside of the generally understood wavelengths of light that are normally visible to humans. Non-visible light NVL radiated by non-visible light source 90 can comprise light radiated at a broad range or ranges of wavelengths, non-visible light radiated at a narrow range of wavelengths or non-visible light radiated at a single wavelength such as for example where a laser diode or laser system is used to generate the non-visible light. In certain applications, non-visible light source 90 can radiate visible light in addition to the non-visible light NVL.

It will further be appreciated that the selection of non-visible wavelengths is advantageous for use in detecting portions of the donor ribbon having protective donor material in that protective donor material is typically provided that allows at least some visible light to pass through and is often clear or transparent, making it difficult to detect the visible wavelength.

When non-visible light NVL radiated by non-visible light source 90 strikes donor ribbon 30, a portion of the non-visible light NVL is absorbed by donor ribbon 30 and a portion of the non-visible light that is not absorbed, herein after referred to as non-absorbed light NAL, leaves donor ribbon 30 and travels to a non-visible light sensor 92. In the embodiment illustrated in FIG. 1, non-absorbed light NAL comprises that portion of non-visible light NVL that passes through donor ribbon 30 to non-visible light sensor 92. Typically, NVL source 90 and NVL sensor 92 will be used to generate a blank or background file from the reflective surface to be ratioed with the sample file collected from the donor ribbon so that the non-visible light sensor 92 is positioned to sense non-absorbed light NAL and to generate a light sensor signal indicative of the non-absorbed light NAL received thereby (step 104). Non-visible light sensor 92 can be adapted to generate a light sensor signal that reflects an intensity of the non-absorbed light NAL at a particular non-visible wavelength or at a range of non-visible wavelengths. Alternatively, light sensor 92 provides a light sensor signal that represents the intensity of non-absorbed light NAL at a pattern of more than one wavelengths of interest. In still other alternative embodiments, the light sensor 92 can be adapted to generate a light sensor signal that represents an average, median or other statistical or mathematical representation of non-absorbed light NAL at one or more selected wavelengths.

It will be appreciated that different ones of donor patches 34, 36, 38 and 40 will absorb non-visible light NVL in different ways. In particular, a donor patch set often contains a protective material donor patch 40.1 that includes materials that are particularly effective for absorbing ultra-violet light or other forms of non-visible light. Accordingly, when a non-visible light source 90 directs non-visible light NVL, for example, an ultraviolet light through an unused portion of a protective material donor patch 40 having a protective donor material that absorbs ultraviolet light, a substantial amount of the ultraviolet light is absorbed. However, during printing, the protective donor material in protective material donor patch 40 is largely transferred to receiver medium 26. Accordingly, when non-visible light source 90 directs a non-visible ultraviolet light to a portion of protective material donor patch 40 that has been used, the amount of such ultraviolet light absorbed is differentially lower between portions of a protective material donor patch 40.1 that have been used as compared to the amount of absorption by portions that have not been used.

There are a variety of factors that may cause a protective donor material to absorb non-visible light. For example, some protective donor materials contain specially added donor materials that are intended to absorb ultraviolet, infrared light or other types of non-visible light NVL. In other examples, protective donor material can contain material having inherent properties that absorb non-visible light NVL in a manner that is differentiable from the manner that portions of a protective donor patch that do not have protective donor material absorb such non-visible light NVL.

Figure 6:
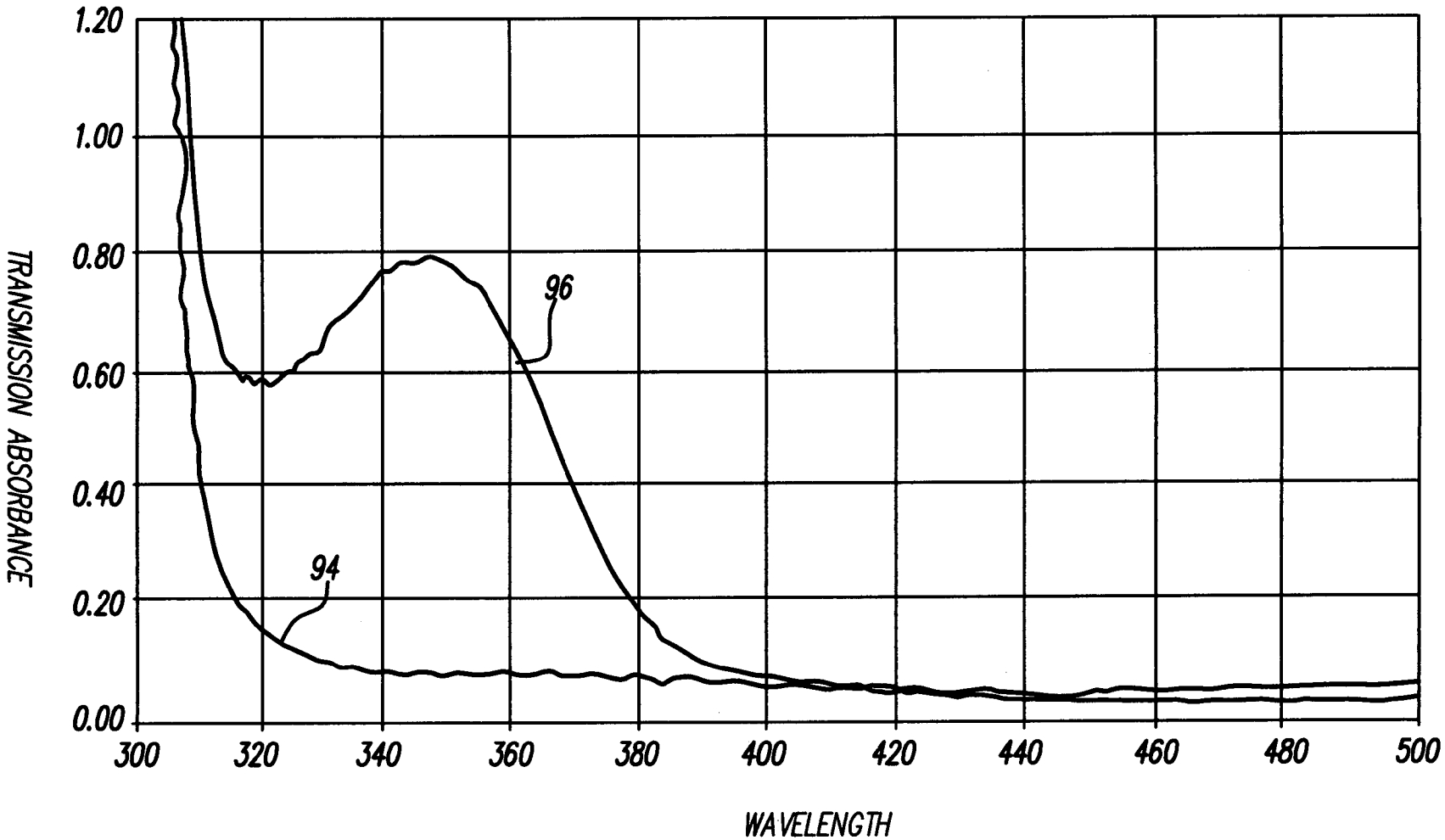
FIG. 6 illustrates one example of a difference in absorbance between a portion of a protective material donor patch having unused donor material and a portion of a protective material donor patch that has been used to apply donor material to a receiver medium.

One example of the difference in absorption of non-visible light NVL between a portion of a protective material donor patch that has been used to apply protective donor material to a receiver medium and an unused portion of a protective material donor patch is illustrated in FIG. 6. FIG. 6, shows a first plot 96 illustrating the transmission absorbance of donor ribbon 30 at various wavelengths of non-visible light in an unused portion of protective material donor patch 40 and a second plot 94 illustrating the transmission absorbance of a donor ribbon 30 at the same range wavelengths in an area of a protective material donor patch 40 that has been used for forming a protective layer or receiver medium 26 that otherwise has no overcoat material. As can be seen in FIG. 6, there are significant differences in transmission absorbances at particular wavelengths and at particular ranges of wavelengths. These differences will be reflected in the non-absorbed light NAL received at a non-visible light sensor 92 and correspondingly in the light sensor signal.

Controller 20 can therefore use the light sensor signal and these known absorbance differences to determine whether a donor patch set 32 contains a full donor patch set, a fractional donor patch set, or an exhausted donor patch set (step 108).

It will be appreciated that the sensing of protective donor material is an advantageous way of detecting the status of a donor patch set in that the protective donor material is typically transferred as a uniform layer of material over the printed image. Accordingly, there is a clearly detectable demarcation or border between used and unused portions of the protective material donor patch. This reduces the risk of false determinations and allows controller 20 to accurately sense whether a donor patch set comprises a full donor patch set, or a fractionally used donor patch set or a fully used donor patch set. Traditional methods of using a visible light source and visible light sensor to determine if a dye patch has been used for printing are not always a reliable method. The amount transferred from a dye patch is scene dependent, and a used dye patch from a scene with low dye density (like a snow scene) can cause donor sensing errors because there is still a large amount of dye left in a printed dye patch. A second print made with a previously used donor dye patch can give a poor quality print. Thus, protective material sensing whether a donor patch set has been used based upon the condition of the patch is a much more reliable method because the protective overcoat patch is completely transferred to the receiver, independent of the print scene content.

In printer 18, controller 20 uses the non-absorbed light NAL to determine whether a donor patch set has partially used donor patches that move sufficient donor material for printing (step 108) by causing take-up roller 42 to position donor ribbon 30 proximate to non-visible light source 90 and non-visible light sensor 92 so that non-visible light NVL is applied to a first location of a protective material donor patch 40. Controller 20 samples the light sensor signal when light is applied at each location. In a simple embodiment, wherein controller 20 prints only full patch and half patch images, discrimination can be made as to whether protective material donor patch 40 has a full donor patch available based upon the light sensor signal received at the first location. Specifically, it will be understood that controller 20 will typically perform the printing of both a full size image and a half size image using a first portion of each donor patch. Thus, if there is a protective donor material at a location in the first portion, then the donor patch set has not been used for either full patch printing or half patch printing.

If controller 20 determines that the protective donor material in the first portion has been used, controller 20 causes donor ribbon 30 to be moved so that a non-visible light can be applied at a location in the second portion. Controller 20 then causes non-visible light to be applied at that location and receives a light sensor signal. This allows a determination to be made as to whether the donor patch set 32 in which donor patch 40 has sufficient donor material remaining for use in printing a half sized image.

When controller 20 determines that a fractional donor patch set is available (step 108), controller 20 then determines whether any portion of the print order can be satisfied at least in part using donor material of the fractional donor patch set (step 110). Where such a portion of the print order can be printed using the remaining donor material in a donor patch set, controller 20 will cause donor ribbon 30 to be positioned so that remaining portions of a fractional donor patch are used in rendering at least a portion of the print order (step 112). Where the print order cannot use the fractional donor set to render the print order, the printer can position a subsequent donor patch set, i.e. second donor patch set 32.2, for use in rendering the job order (step 114).

Figure 7:
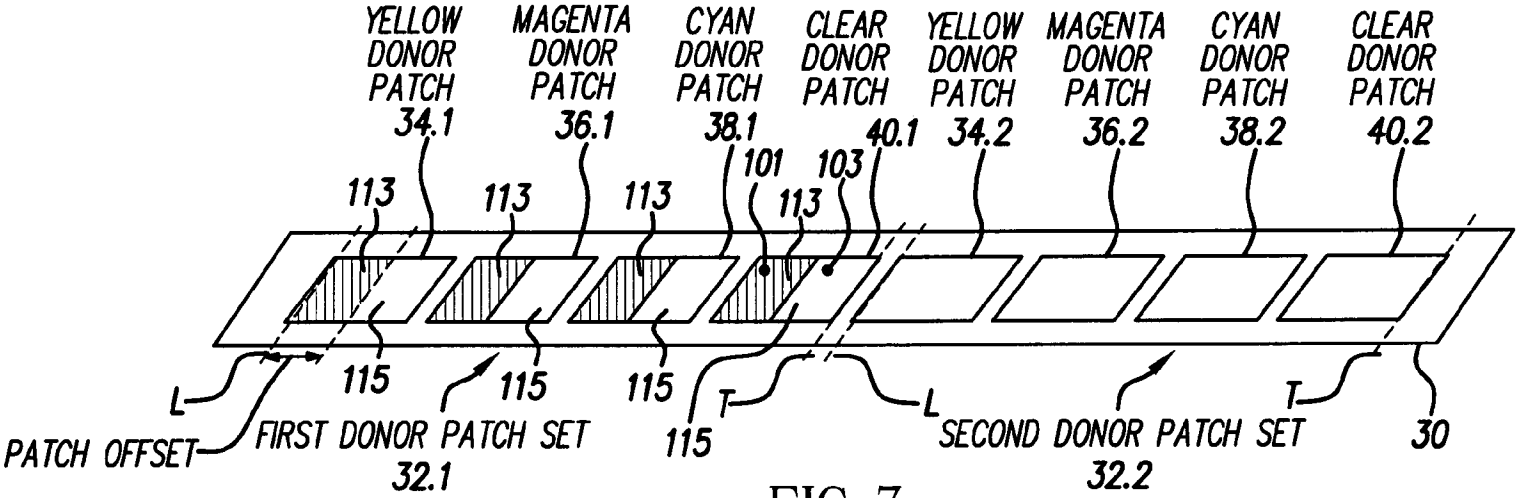
FIG. 7 illustrates an application of the method of FIG. 5 to a donor ribbon having fractionally used donor patches.
Figure 8:
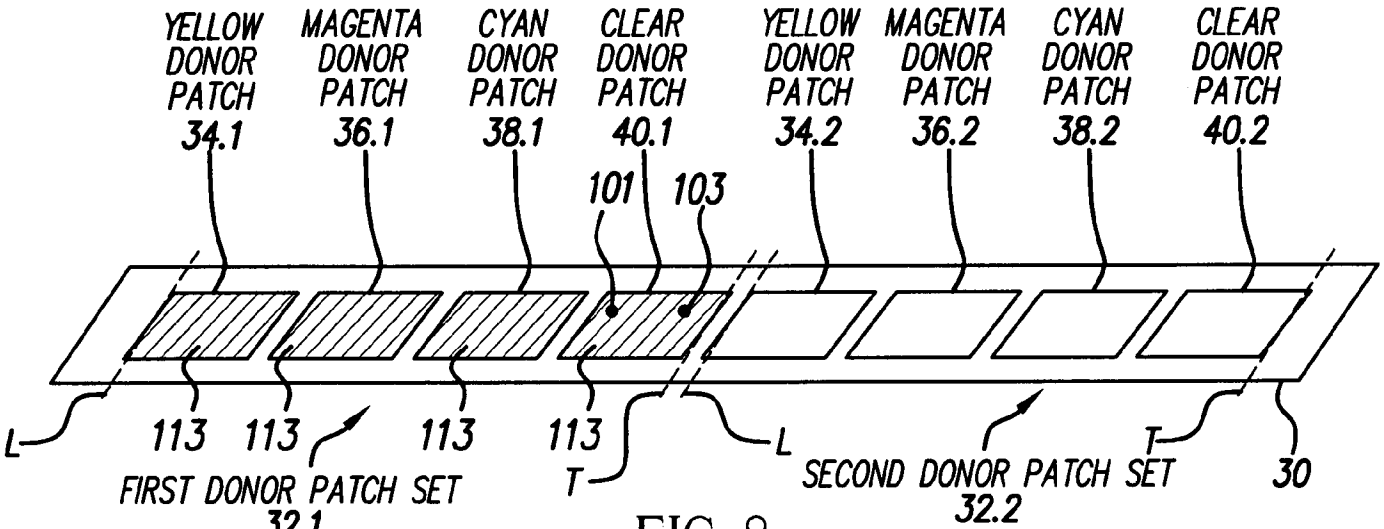
FIG. 8 illustrates an application of the method of FIG. 5 to a donor ribbon having fully used donor patches.

FIGS. 7 and 8 illustrate the application of one embodiment of the method of FIG. 5 to first donor patch set 32.1. FIG. 7 illustrates a donor ribbon 30 located in printer 18 with a first donor patch set 32.1 having donor patches 34.1, 36.1, 38.1 or 40.1 having used portion 113 and unused portion 115. When a print order is received (step 100), controller 20 then positions donor ribbon 30 so that the non-visible light source 90 will apply non-visible light NVL (step 102) to donor ribbon 30 at a first location 101, and will cause non-visible light sensor 92 to sense the non-absorbed light NAL from donor ribbon 30 (step 104). First location 101 is selected to be a location within protective material donor patch 40.1 where the presence or absence of donor material in donor patch 40.1 at first location 101 will be determinative of whether first donor patch set 32.1 comprises a full patch set or patch set that has at least partially been used. Controller 20 then moves donor ribbon 30 so that non-visible light NVL is applied to a second location 103, which is at a location within protective donor patch 40.1 at which the presence or absence of donor material indicates, respectively, that donor patch 40.1 has a half patch of donor material remaining or that donor patch 40 has been fully used. Controller 20 receives the light sensor signal and uses this signal to determine whether unused donor material is present.

In FIG. 7, the absence of donor material at first location 101 and the presence of donor material at second location 103 indicates that donor patch set 32.1 contains a set of donor patches with a half patch of donor material is available. However, if the donor ribbon 30 shown in FIG. 8 is loaded into printer 18, the absence of donor material at first and second locations 101 and 103 indicates that no donor material is available in donor patch set 32.1.

As is described above, controller 20 determines whether a portion of the print order can be printed using donor patch set 32.1 based upon the amount of donor material remaining in donor patch set 32.1 and characteristics of the image to be printed (step 110). Where this is possible, controller 20 can cause the remaining portions of donor patch set 32.1 to be used to print any portion of the order that can be printed using donor material from the fractional donor patch set 32.1 (step 112). Where it is not possible to use any fraction of first donor patch set 32.1 for printing, controller 20 causes donor ribbon 30 to be advanced so that the second donor patch set 32.2 can be used for printing (step 114). Thus, in the example illustrated in FIGS. 7 and 8, controller 20 can determine which portions of donor patches 34.1, 36.1, 38.1, 40.1, are unused.

It will be appreciated that, in order to use donor material from the fractional donor patch set 32.1 in rendering a portion of the print order, controller 20 must be capable of properly positioning donor patch set 32.1 so that printhead 22 confronts only portions of the donor patches 34.1, 36.1, 38.1 and 40.1 that were not used previously. This requires that controller 20 determine which portions of each donor patch remain unused and that printer controller 20 is also capable of properly and accurately positioning donor ribbon 30 relative to printhead 22 for printing using remaining portions.

In embodiments of printer 18 where controller 20 is adapted to enable printing in either of a full patch or half patch mode where printing consumes half of the available donor material in the donor patches of a donor patch set, controller 20 can be programmed to controllably position donor ribbon 30 so that unused portions of a first donor patch set 32.1 can be used in rendering at least a part of a print order. This can be done by selectively causing rotation of donor ribbon take-up roller 48 and donor ribbon supply roller 50 while monitoring sensor signals from donor position sensor 82 to determine the leading edge of donor patch set 32.1, and by using movement sensor 86 to monitor the extent to which donor ribbon 30 is moved relative to leading edge LED. When controller 20 determines that donor ribbon 30 positioned at a location that is offset from the start position of each patch by the known half patch distance, controller 20 can print using the remaining portions of the patch.

Figure 9:
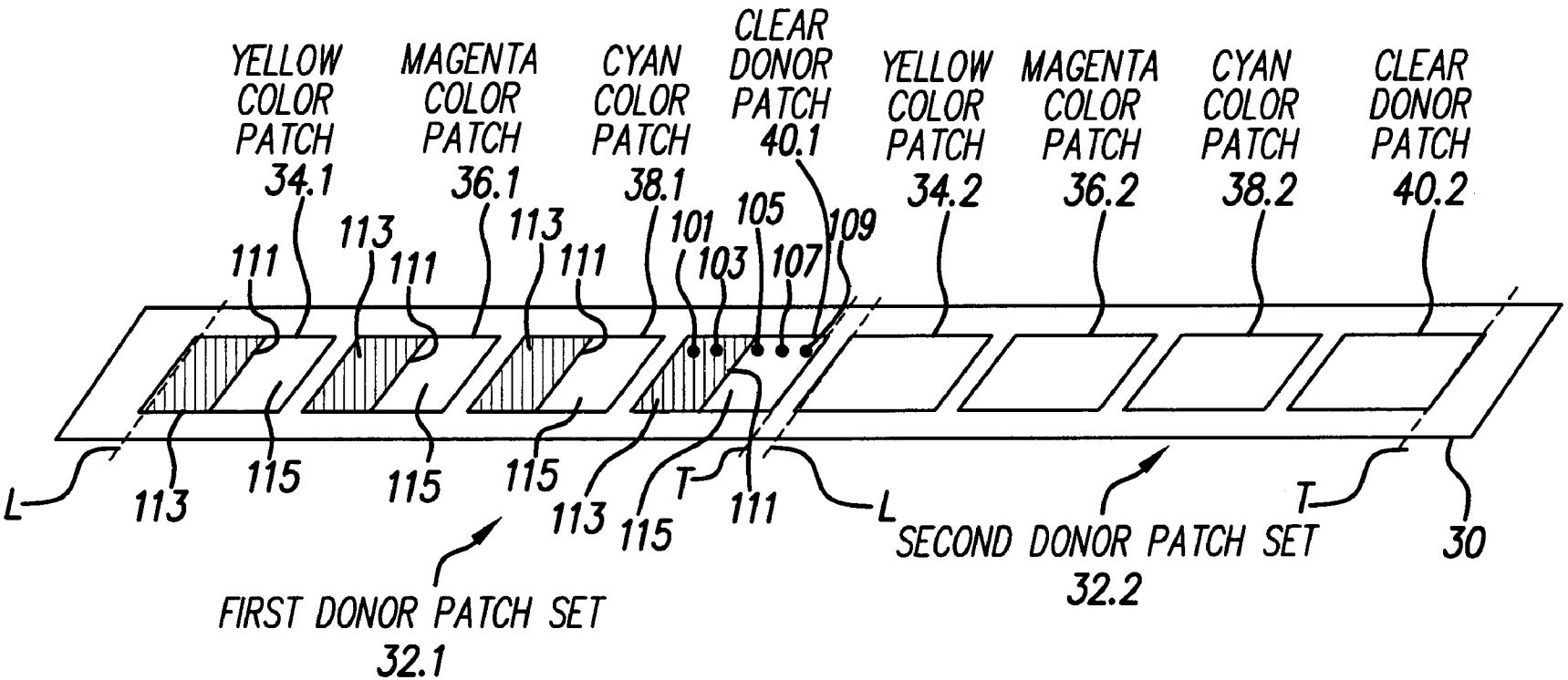
FIG. 9 illustrates the use of obtaining a plurality of light sensor signals obtained in a plurality of locations to locate a border.

However, in an embodiment where controller 20 allows printing to be performed in a manner that leaves fractions of donor material that are variably sized, controller 20 can optionally dynamically determine a location for positioning the donor patches of first donor patch set 32.1 so that unused fractions of each donor patch are positioned for printing. As illustrated in FIG. 9, controller 20 can cause a plurality of light sensor signals to be obtained at a plurality of locations 101, 103, 105, 107 and 109. Such light sensor signals can be obtained in a pattern that is designed to allow controller 20 to sense a border 111 between used portion 113 of protective material donor patch 40.1 and the unused portion 115 of protective material donor patch 40.1.

After the location of border 111 is detected in this manner, controller 20 can determine a patch offset distance based upon the size of the donor patches in donor patch set 32.1 and the location of detected border 111. For example, where donor patches 34.1, 36.1, 38.1 and 40.1 of first donor patch set 32.1 shown in FIG. 9 are each 6"×8" patches and where the first print order required a first print that was for example of 5"×3" size, a border 111 between an unused portion 112 and a used portion 114 of protective donor patch 40.1 can be detected. The distance from a leading edge 119 of protective material donor patch 40.1 to the detected border 111 is then used to determine a patch offset distance. In this example of FIG. 9, the offset distance is a distance of three inches.

When a subsequent print order is received that requires the printing of an image that can be printed using the remaining 5"×6" area of donor patch set 32.1, controller 20 causes donor ribbon 30 to be positioned at a start of a first donor patch in a fractional donor patch set. Controller 20 then causes donor ribbon 30 to be moved forward by the patch offset distance of three inches from a leading edge L of first donor patch 34.1 in first donor patch set 32.1, so that printing begins at that point and continues for no more than another five inches using yellow donor patch 34.1. Controller 20 causes donor ribbon 30 to be moved so that printing of a subsequent donor patch, e.g. magenta donor patch 36.1, begins at the determined offset distance of three inches from the start of the next donor patch. This process repeats for each remaining donor patch, exhausting all of the remaining unused portions of the donor patches in the donor patch set, e.g. cyan patch 38.1 and protective material donor patch 40.1. As is apparent from this example, controller 20 could potentially print a 5"×6" image or two 2.5"×3" images or any number of other combinations of images using the unused portion 114 of patch set 32.1 illustrated in FIG. 9.

In this way, unused fractions of a donor patch set 32.1 can be used to render at least a part of a print order without requiring controller 20 have access to and/or maintain data in a memory that indicates whether such a fraction donor patch set is available and/or the extent of donor material remaining in such a fractional donor patch set.

Figure 10:
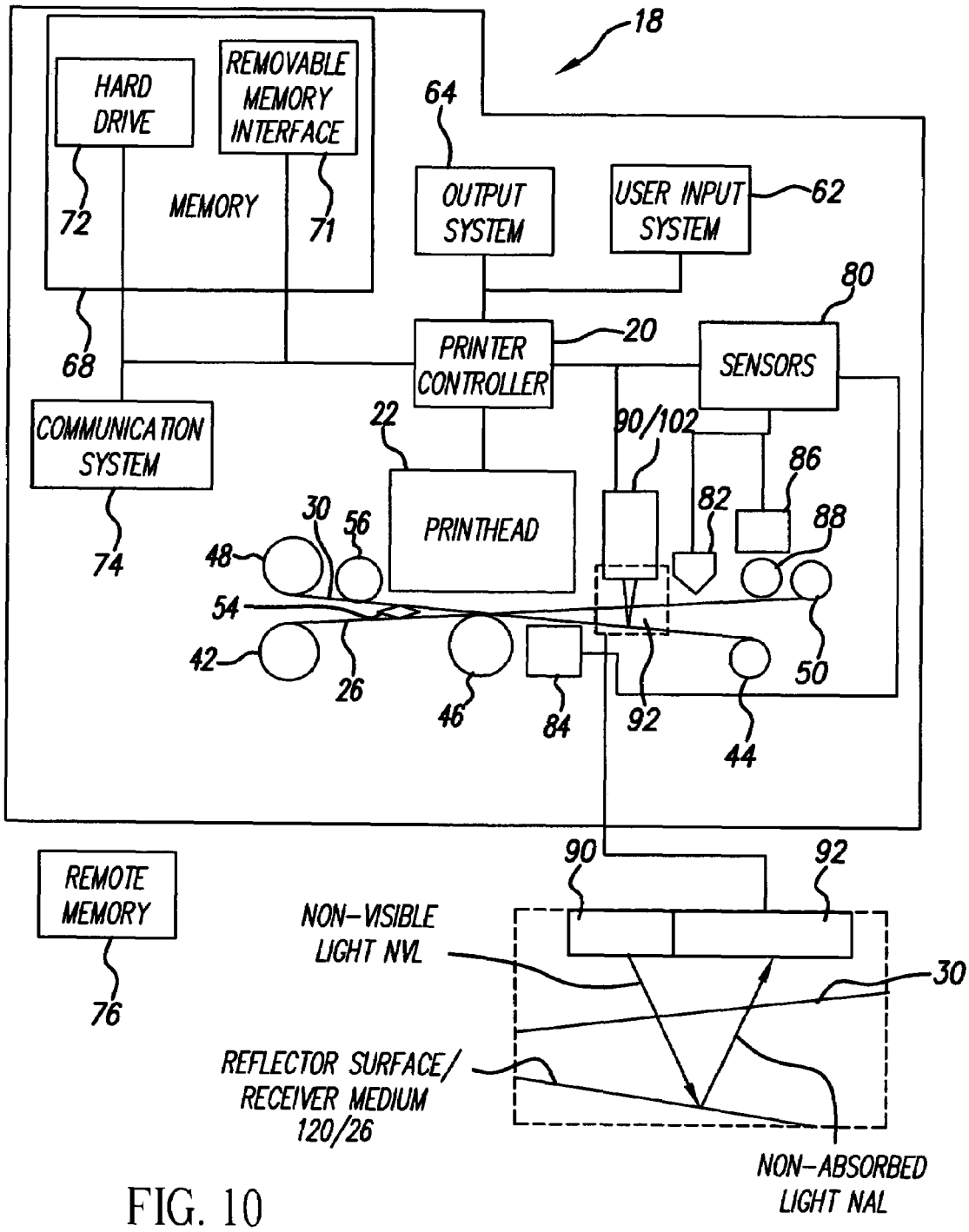
FIG. 10 shows another embodiment of a printer of the invention.

FIG. 10 shows another embodiment of printer 18 having a different arrangement of a non-visible light source 90 and a non-visible light sensor 92. In this embodiment, the non-visible light NVL passes through donor ribbon 30 and is reflected by a reflector surface 120 and that then again passes through donor ribbon 30 on the path to non-visible light sensor 92. Examples of reflector surface 120 that could be used to reflect such light include a mirrored surface or some other structure that is permanently located in printer 18 such as a peel plate, a platen, a roller or the like. In the embodiment, shown, the reflecting structure comprises receiver medium 26.

It will be appreciated that this arrangement has the advantage of passing non-visible light NVL through donor ribbon 30 twice, thus increasing the relative extent of light absorption and thereby increasing the accuracy with which discrimination can be made. However, it will also be appreciated that the light sensor signal obtained must be analyzed in a manner that considers that the light sensed by non-visible light sensor 92 will not have light therein that has been absorbed or otherwise directed away from light sensor 92 by the reflecting surface. In this regard, controller 20 can be adapted to determine said information at least in part by excluding known or anticipated changes in the non-visible light introduced when said non-visible light is reflected. However, where the receiver medium 26 is used to reflect the light, controller 20 can also be adapted to determine information regarding the receiver medium 26 from the non-absorbed NAL such as a receiver medium type.

Figure 11:
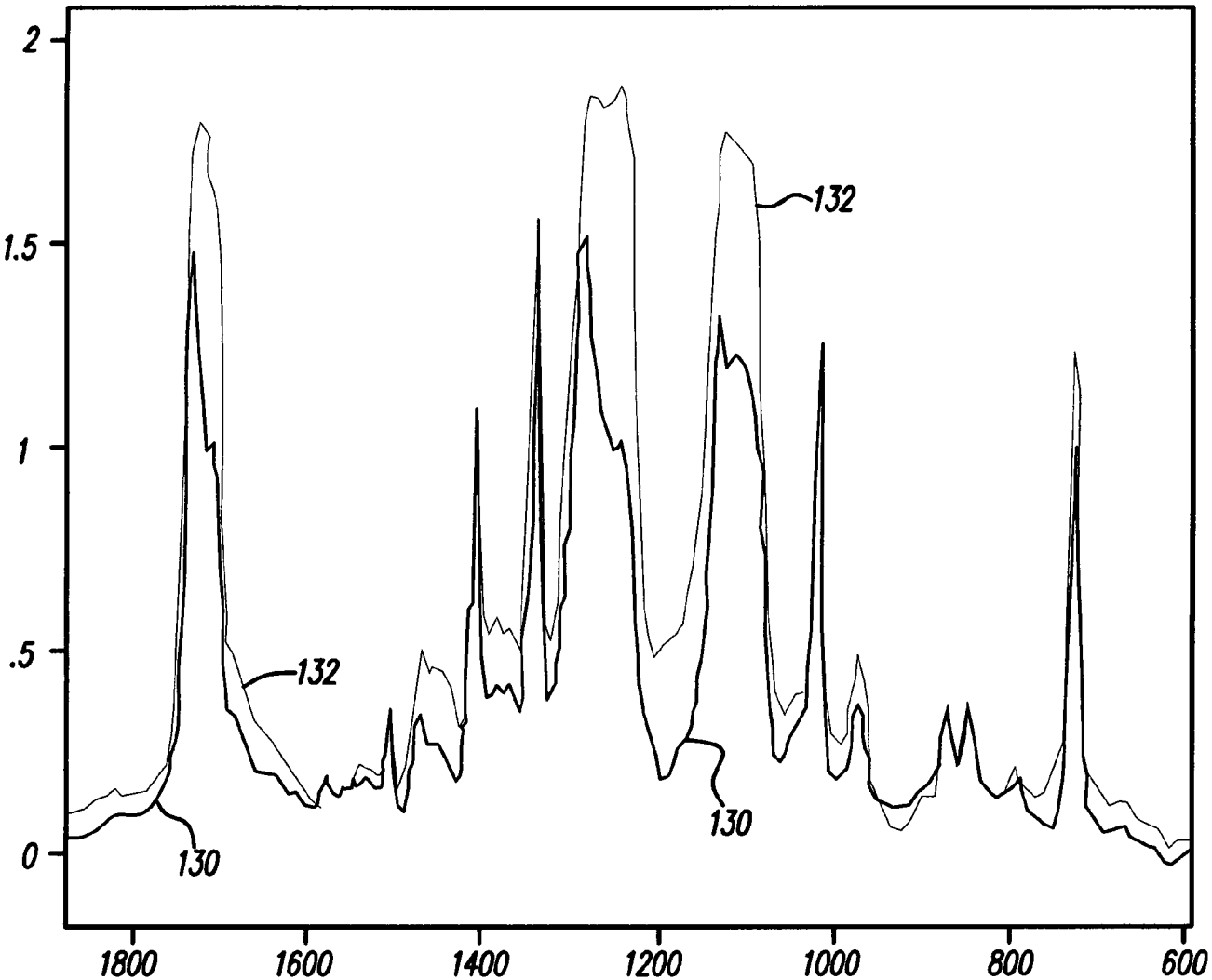
FIG. 11 illustrates one example of the reflection absorption of protective material donor patches used and unused over a range of wavelengths in the infrared region.

As is noted above, non-visible light NVL can comprise non-visible light in wavelengths other than ultraviolet wavelengths. FIG. 11 illustrates one example of the reflection absorption of a donor ribbon 30 over a range of wavelengths in the infrared region. In FIG. 11, a first plot line 130 that shows the absorbance of a portion of protective material donor patch 40.1 having used protective material and a second plot line 132 shows the absorbance of a portion of a protective donor ribbon 30 that was unused. As shown in FIG. 11, at various infrared wavelengths there are significant differences in absorbance. These differences can be used to determine the presence of unused protective donor material on donor ribbon 30.

Figure 12:
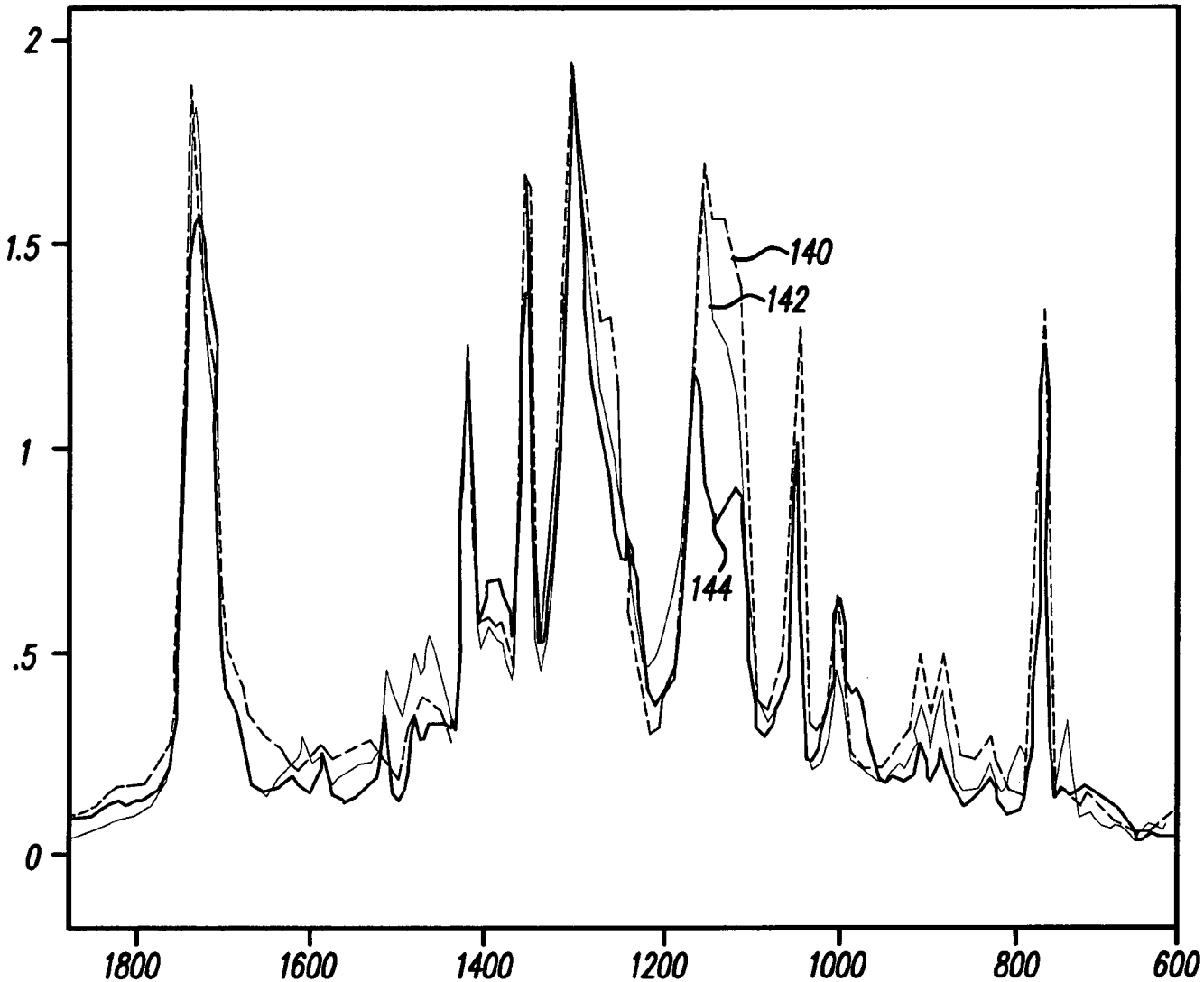
FIG. 12 illustrates differences in reflection absorption between unused protective material donor patches for three different donor material types.

It will also be appreciated that controller 20 can advantageously use the light sensor signal for various other purposes. Accordingly, the method of FIG. 5 shows that controller 20 can perform the optional step (step 106) of determining printing information such as donor material type, a donor material thickness, or the condition of the donor ribbon 30 based upon analysis of the non-absorbed light NAL. For example, as shown in FIG. 12, different types of donor ribbons 30 can be used in printer 18 and such donor ribbons 30 can exhibit different absorption characteristics at different wavelengths of non-visible light. The measured absorbance of three unused portions of a protective material donor patch on three different donor mediums are represented by one of plot lines 140, 142, and 144. A controller 20 can use these absorbance differences of the type illustrated in FIG. 12 to discriminate between donor material types based upon the analysis of non-absorbed light NAL. Further, it will be appreciated that the thickness of the protective material donor patch will be proportional to the absorbance of the donor material. Due to possible variations in the thickness of the donor samples, a peak ratio technique may be required to determine differences between used and unused media and material donor types.

As illustrated in FIG. 12, discrimination between such mediums can be made based upon differences in such patterns of measured absorbance.

The invention has been described in detail with particular reference to certain preferred embodiments thereof, but it will be understood that variations and modifications can be effected within the spirit and scope of the invention.

PARTS LIST

18 printer
20 printer controller
22 printhead
26 receiver medium
30 donor ribbon
32:1 first donor patch set
32.2 second donor patch set
34.1 yellow donor patch
34.2 yellow donor patch
36.1 magenta donor patch
36.2 magenta donor patch
38.1 cyan donor patch
38.2 cyan donor patch
40.1 protective material donor patch
40.2 protective material donor patch
42 receiver medium take-up roller
44 receiver medium supply roller
46 platen roller
48 donor ribbon take-up roller
50 donor ribbon supply roller
52 image receiving area
54 stripping plate
56 idler roller
62 user input system
64 output system
68 memory
71 removable memory interface
72 hard drive
74 communication system
76 remote memory
80 sensor system
82 donor position sensor
84 receiver medium position sensor
86 movement sensor
88 follower wheel
90 non-visible light source
92 non-visible light sensor
94 second plot
96 first plot
100 receive print order step
101 first location
102 project non-visible light onto donor ribbon step
103 second location
104 sense non-absorbed portion of non-visible light step
105 third location
106 determine donor ribbon characteristics step
107 fourth location
108 determine whether donor patch set has a partial donor patch step
109 fifth location
110 can print order satisfied by using fractional donor patch set determining step
111 border
112 print using fractional donor patch step
113 used portion of protective material patch
114 print using full donor patch set step
115 unused portion of protective material patch
119 leading edge protective material donor patch
120 reflector surface
130 first plot line representing the absorbance of a used portion of a protective material donor patch
132 second plot line representing the absorbance of an unused portion of a protective material donor patch
140 plot line representing absorbance of unused protective material donor patch for first medium
142 plot line representing absorbance of unused protective material donor patch for second medium
144 plot line representing absorbance of unused protective material donor patch for third medium
L leading edge
T trailing edge
LED leading edge of yellow donor patch
LER leading edge of image receiving area
NVL non-visible light
NAL non-absorbed light
NAP1-NAPx non-absorbed light sample
TER trailing edge of image receiving area

The invention claimed is:

1. A thermal printer adapted to print using a donor ribbon having sets of donor material patches each set including at least one colored donor material patch and a protective material donor patch, said donor ribbon absorbing a greater portion of an applied non-visible light in an area of the donor ribbon having unused protective donor material than in areas that do not have unused protective donor material; the thermal printer comprising:

a donor transport system having a motorized system for advancing the donor ribbon relative to a printhead;

a light source radiating non-visible light onto the donor ribbon; and, a light sensor positioned to sense a non-absorbed portion of the non-visible light radiated onto the donor ribbon and to generate a light sensor signal indicative of the non-visible light received;

a controller being adapted to position the donor ribbon relative to the light source and the light sensor, to cause the light source to radiate non-visible light onto the donor ribbon and to receive the light sensor signal;

said controller further being adapted to use the light sensor signal to identify whether the portion of the donor web confronting the light source and light sensor has unused protective donor material.

2. The printer of claim 1, wherein said the non-visible light is within the ultraviolet wavelengths or infrared wavelengths.

3. The printer of claim 1, wherein said light sensor is positioned to receive a non-absorbed portion of the non-visible light that has passed through the donor ribbon once.

4. The printer of claim 1, wherein said controller is further adapted to use the light sensor signal to determine at least one of a donor material type, a protective donor material thickness, and the location of a border between a used portion of a protective material donor patch and an unused portion of the protective material donor patch on the donor ribbon.

5. The printer of claim 1, wherein said light sensor is positioned to receive light that has passed through the donor ribbon once and then reflected again through the donor ribbon to the light sensor.

6. The printer of claim 5, wherein the non-visible light is reflected by a component of the printer.

7. The printer of claim 5, wherein a receiver medium reflects the non-visible light.

8. The printer of claim 7, wherein said controller is further adapted to use the light sensor signal to determine at least one of a donor type, a donor material thickness, a location of a border between used and unused portions of a protective material donor patch on the donor ribbon, and a receiver medium type.

9. The printer of claim 5, wherein said component of the printer absorbs a portion of the non-visible light and wherein said controller is adapted to determine whether a portion of the donor web has protective donor material based upon the light sensor signal and based upon a measured or estimated portion of the non-visible light absorbed by the component of the printer that reflects the non-visible light.

10. The printer of claim 1, wherein said controller is further adapted to obtain at least two samples of non-absorbed portions of non-visible light applied to separate portions of a donor patch and to determine a location of a border between a used portion of a protective donor patch and an unused portion of a protective donor patch when consecutive samples of non-absorbed portion of the non-visible light comprise samples that alternately indicate the presence and absence of unused donor material.

11. A method for operating a printer that applies donor material from donor patches on a donor ribbon to a receiver medium, said donor patches being organized into sets each set including at least one colored material donor patch and a protective material donor patch, the method comprising the steps of:

applying a non-visible light to a location on the donor ribbon;

sensing a portion of non-visible light that is not absorbed by the donor ribbon; and determining whether the portion of the donor ribbon to which the non-visible light has been applied has unused protective donor material thereon, said determining being based upon the sensed non-visible light.

12. The method of claim 11, further comprising the step of determining that a donor patch set has full patches of unused donor material available when it is determined that unused protective donor material is present at a location in the donor patch set that is used every time that an image is printed using the donor patch set.

13. The method of claim 11, further comprising the step of determining that a donor patch set is a donor patch set with fractions of donor patch material available when it is determined that unused protective donor material is not present at one location in the protective donor patch but is present at a second location in the protective donor patch.

14. The method of claim 13, further comprising the step of determining the extent of unused donor material in a donor patch set by advancing the donor ribbon so that it can be determined which locations within a protective material donor patch have protective donor material and which portions do not have protective donor material associated therewith based upon the sensed non-visible light.

15. The method of claim 11, further comprising the step of determining a donor material or type of donor thickness based upon analysis of sensed non-visible light.

16. The method of claim 11, wherein said sensing of the non-visible light comprises sensing non-visible light that is passed through the donor ribbon once and then reflected again through the donor ribbon to the light sensor.

17. The method of claim 16, wherein the non-visible light is reflected by a component of the printer.

18. The method of claim 16, wherein a receiver medium reflects the non-visible light.

19. The method of claim 16, further comprising the step of determining a donor material type, a donor material thickness, a location of an edge of the protective material donor patch, or a receiver medium type based upon analysis of the sensed non-visible light.

20. The method of claim 16, wherein said step of determining is at least in part determined based upon the sensed non-absorbed light and based upon known or anticipated changes in the non-visible light introduced when said non-visible light is reflected.

21. A method for operating a printing system that applies donor material from a donor ribbon having donor patch sets, each donor patch set comprising at least one colored donor material patch and a protective material donor patch said protective material donor patch having a material therein that absorbs non-visible light; said method comprising the steps of:

applying a non-visible light to a first location within the protective material donor patch;

sensing non-visible light that is not absorbed by the protective material donor patch at the first location;

determining whether there is unused protective donor material at the first location based upon the non-visible light sensed at the first location;

applying non-visible light to a second location within the protective material donor patch;

sensing non-visible light that is not absorbed by the protective material donor patch at the second location;

determining whether there is unused donor material at the second location based upon the non-visible light sensed at the second location;

determining that the donor patch set has not been used when unused protective donor material is present at the first location;

determining that the donor patch set is fully exhausted when it is determined that there is no unused protective donor material at the second location; and determining that the donor patch set has been used but has sufficient donor material available for fractional size printing when no unused protective donor material is found at the first location but unused protective donor material is found at the second location.

* * * * *